US011585027B2

(12) United States Patent
Moshe et al.

(10) Patent No.: US 11,585,027 B2
(45) Date of Patent: Feb. 21, 2023

(54) AUTHENTICATION FOR DIGITAL DYEING

(71) Applicant: TWINE SOLUTIONS LTD., Petach Tikva (IL)

(72) Inventors: Alon Moshe, Petach Tikva (IL); Mirta Perlman, Bet Elazari (IL)

(73) Assignee: TWINE SOLUTIONS LTD., Petach Tikva (IL)

( * ) Notice: Subject to any disclaimer, the term of this patent is extended or adjusted under 35 U.S.C. 154(b) by 495 days.

(21) Appl. No.: 16/756,596

(22) PCT Filed: Oct. 17, 2018

(86) PCT No.: PCT/IL2018/051112
§ 371 (c)(1),
(2) Date: Apr. 16, 2020

(87) PCT Pub. No.: WO2019/077606
PCT Pub. Date: Apr. 25, 2019

(65) Prior Publication Data

US 2020/0332446 A1 Oct. 22, 2020

Related U.S. Application Data

(60) Provisional application No. 62/573,202, filed on Oct. 17, 2017.

(51) Int. Cl.
*D06B 3/04* (2006.01)
*D05C 11/24* (2006.01)
(Continued)

(52) U.S. Cl.
CPC ..... *D05C 11/24* (2013.01); *B41J 3/407* (2013.01); *D06B 3/04* (2013.01); *D06B 3/06* (2013.01);
(Continued)

(58) Field of Classification Search
CPC . D05C 11/24; B41J 3/407; D06B 3/04; D06B 3/06; D06B 11/0023; D06H 1/043; D06P 5/30; B05D 5/00
See application file for complete search history.

(56) References Cited

U.S. PATENT DOCUMENTS 6,189,989 B1 * 2/2001 Hirabayashi ..... D06P 5/30 427/288

FOREIGN PATENT DOCUMENTS

CN 202913146 5/2013
DE 102008039735 3/2010
(Continued)

*Primary Examiner* — Yaovi M Ameh
(74) *Attorney, Agent, or Firm* — JMB Davis Ben-David

(57) ABSTRACT

An article of manufacture, comprising, an artifact formed from at least a portion of at least one continuous artifact fiber, the artifact fiber dyed by a first digitally controlled dyeing process to exhibit a visible first color section and a visible color gradient section transitioning from and visibly distinguishable from the first color section; and, a textile portion, comprising at least one dyed fiber that has been dyed by a second digitally controlled dyeing process; wherein said artifact fiber is dyed by the first dyeing process applying metadata, said metadata relating to at least said first color, and wherein said textile portion fiber is dyed at least said first color by the second dyeing process applying said metadata.

20 Claims, 9 Drawing Sheets

(51) Int. Cl.

| | |
|---|---|
| ***B41J 3/407*** | (2006.01) |
| ***D06B 11/00*** | (2006.01) |
| ***D06P 5/30*** | (2006.01) |
| ***D06B 3/06*** | (2006.01) |
| ***D06H 1/04*** | (2006.01) |
| *B05D 5/00* | (2006.01) |

(52) U.S. Cl.
CPC ..... *D06B 11/0023* (2013.01); *D06H 1/043* (2013.01); *D06P 5/30* (2013.01); *B05D 5/00* (2013.01)

(56) References Cited

FOREIGN PATENT DOCUMENTS

| | | | | | |
|---|---|---|---|---|---|
| DE | 102008039735 | A1 | † | 3/2010 | |
| JP | 06304359 | A | * | 11/1994 | ..... D05B 21/00 |
| JP | H06304359 | | † | 11/1994 | |
| JP | 2002200382 | | | 7/2002 | |
| JP | 2002200382 | A | † | 7/2002 | |
| WO | WO-2010076823 | A1 | * | 7/2010 | ..... B41J 3/407 |
| WO | 2017013651 | | | 1/2017 | |
| WO | 2017013651 | A1 | † | 1/2017 | |

* cited by examiner
† cited by third party

AUTHENTICATION FOR DIGITAL DYEING

This is the US National Stage of International Patent Application No. PCT/IL2018/051112 filed on Oct. 17, 2018, which in turn claims the benefit under 35 U.S.C. § 119(e) of U.S. Provisional Patent Application No. 62/573,202 filed Oct. 17, 2017, the contents of which are incorporated herein by reference in their entirety.

FIELD OF THE DISCLOSED TECHNIQUE

The disclosed technique relates to digital dyeing, in general, and to methods and systems for authenticating a digital dyeing process, in particular.

BACKGROUND OF THE DISCLOSED TECHNIQUE

The textile dyeing industry typically consumes large volumes of fresh water, which then become polluting waste. This wastewater often contains toxic and reactive residues and chemicals that pose a hazard to the public. As a result, many resources must be invested in wastewater treatment before releasing this byproduct into public sewage systems. Given that clean, safe water is already in short supply in many parts of the world, addressing this environmental hazard is of paramount importance.

One of the many advantages that digitally controlled dyeing processes have over traditional dyeing processes is that the digital technology consumes only small fraction of the water that would normally be used in conventional methods. For example, PCT application PCT/IL2016/050789 discloses a digitally controlled dyeing process. This "eco-friendliness" can be beneficial for marketing digitally dyed textiles to an environmentally aware public who might be eager to adjust consuming habits towards ecologically sound products. However, it is often difficult to differentiate between a conventionally dyed textile with one that was dyed digitally. Thus, merely affixing a label to a digitally dyed textile-product attesting to its ecological soundness does not protect the consumer from purchasing a fraudulent imitation, as a manufacturer may falsely affix a label to a non-digitally dyed textile product and make a claim that the conventionally dyed textile product is digitally dyed.

Several techniques are known for authenticating digitally printed content. Additionally, techniques are known for authenticating digital printers used to print content having inherent value, such as currency, or postage stamps.

U.S. Pat. No. 6,727,953 describes printing an authenticating identifier when printing currency or postage stamps.

U.S. Pat. No. 7,055,746 describes a personal postage stamp printer. The printer prints the postage stamp on an adhesive label stock with a color bar sequence and a 2-D barcode sequence that together authorize the stamp. The 2D barcode is downloaded to the postage stamp printer from an administrative server, with the result that the color bar sequence and the 2D barcode vary from stamp to stamp.

US Patent Application Publication 2015/0070733 describes printing the metadata of an image together with the image. The metadata may be subsequently used to identify and track the context, content and history of the printed images. Additionally, the metadata can be used for discovery purposes

SUMMARY OF THE PRESENT DISCLOSURE

In accordance with the disclosure, there is thus provided an article of manufacture, comprising, an artifact formed from at least a portion of at least one continuous artifact fiber, the artifact fiber dyed by a first digitally controlled dyeing process to exhibit a visible first color section and a visible color gradient section transitioning from and visibly distinguishable from the first color section; and, a textile portion, comprising at least one dyed fiber that has been dyed by a second digitally controlled dyeing process; wherein said artifact fiber is dyed by the first dyeing process applying metadata, said metadata relating to at least said first color, and wherein said textile portion fiber is dyed at least said first color by the second dyeing process applying said metadata.

There is further provided in accordance with the disclosure, a system for producing an artifact authenticating a digitally controlled dyeing process, comprising: a digitally controlled dyeing machine configured to dye at least one continuous thread to exhibit a first color section, and a color gradient section transitioning from said first color section, a controller configured to digitally control the digitally controlled dyeing machine to dye the continuous thread such that an artifact subsequently formed from the dyed thread exhibits at least a portion of the color gradient section, as distinguished from said first color section, thereby authenticating said dyeing process respective of said artifact.

There is further provided in accordance with the disclosure, a method for producing an artifact for authenticating a digitally controlled dyeing process, the method comprising: digitally controlling a dyeing process for at least one continuous thread to dye said at least one continuous thread to exhibit at least a first color section and a color gradient section transitioning from said first color section; dyeing said continuous thread to exhibit said at least a first color section and said at least a color gradient section transitioning from said first color section; and forming said artifact from at least a portion of said continuous color gradient section of said at least one continuous thread, wherein said artifact exhibits said continuous color gradient section as distinguished from said first color section, thereby authenticating said dyeing process.

The foregoing and other objects, features, and advantages will become more apparent from the following detailed description which proceeds with reference to the accompanying figures.

BRIEF DESCRIPTION OF THE DRAWINGS

The disclosed technique will be understood and appreciated more fully from the following detailed description taken in conjunction with the drawings in which.

DETAILED DESCRIPTION OF THE EMBODIMENTS

Figure 1A:
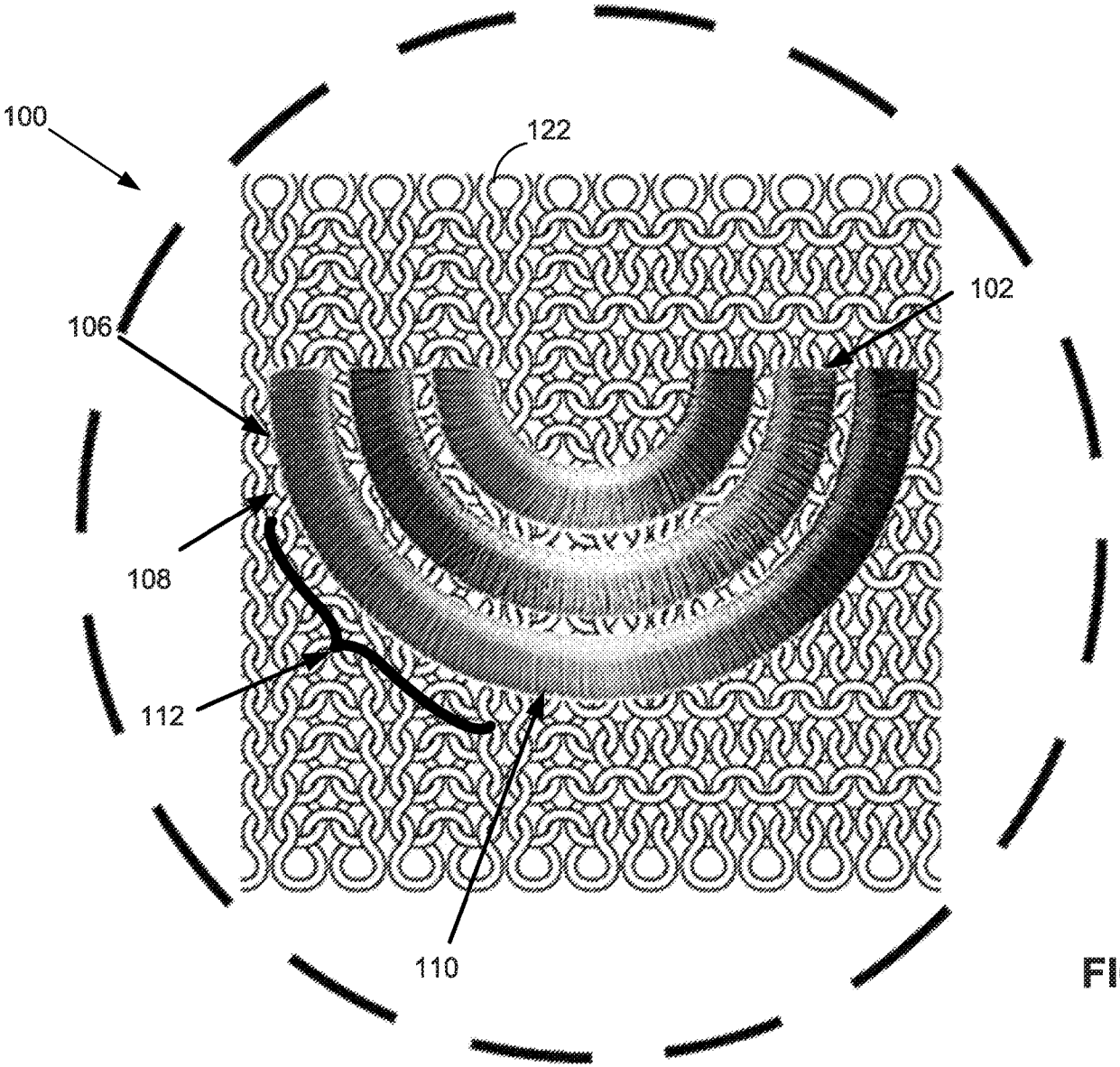
FIGS. 1A-1B, taken together, are a schematic illustration of an artifact authenticating a digitally controlled dyeing process of a product, constructed and operative in accordance with an embodiment of the disclosed techniques.

Some of the embodiments relate to an article of manufacture, comprising, an artifact formed from at least a portion of at least one continuous artifact fiber, the artifact fiber dyed by a first digitally controlled dyeing process to exhibit a visible first color section and a visible color gradient section transitioning from and visibly distinguishable from the first color section; and, a textile portion, comprising at least one dyed fiber that has been dyed by a second digitally controlled dyeing process; wherein said artifact fiber is dyed by the first dyeing process applying metadata, said metadata relating to at least said first color, and wherein said textile portion fiber is dyed at least said first color by the second dyeing process applying said metadata. The artifact fiber may be a thread and the textile portion fiber may be a thread. The artifact may form an embroidered pattern on said article of manufacture. The artifact may form a stitch on said article of manufacture. The artifact may be presented on a label of the article of manufacture. The continuous artifact fiber may be the same continuous fiber of the textile portion fiber. According to an embodiment, at most 10% of the length of said continuous thread comprises a gradient. The artifact may further comprise at least a second color. The second color may correspond to a color of the continuous thread in an undyed state. The metadata may comprise a color scheme. The article may further comprising instruction relating to the artifact. The instructions may comprise text or a digital code indicating one or more of: presence of at least one fiber dyed according to a digitally controlled dyeing process and location of the fiber dyed according to a digitally controlled dyeing process in the article of manufacture. The artifact fiber color gradient section may be between 5 millimeters and 1000 meters long. The article may comprise between 1 and 100 percent dyed fiber that has been dyed by a second digitally controlled dyeing process. The artifact surface area may be between 0.1% and 10% of the article surface area. According to an embodiment, at most 10% of the length of said continuous thread forms the artifact. According to an embodiment, at most 1% of the length of said continuous thread forms the artifact.

Further embodiments of the disclosure relate to a system for producing an artifact authenticating a digitally controlled dyeing process, comprising: a digitally controlled dyeing machine configured to dye at least one continuous thread to exhibit a first color section, and a color gradient section transitioning from said first color section, a controller configured to digitally control the digitally controlled dyeing machine to dye the continuous thread such that an artifact subsequently formed from the dyed thread exhibits at least a portion of the color gradient section, as distinguished from said first color section, thereby authenticating said dyeing process respective of said artifact. Optionally, at most 10% of said dyed thread forms said artifact. The system may further comprise a stitching machine configured to form the artifact from said thread dyed by said digitally controlled dyeing machine, said stitching machine selected from the group consisting of: an embroidery machine, wherein said artifact forms an embroidered pattern, a sewing machine wherein said artifact forms a stitch, a knitting machine wherein said artifact forms a knitted pattern, a weaving machine wherein said artifact forms a woven pattern, and a crocheting machine wherein said artifact forms a woven pattern. The artifact may visually correspond to an article of manufacture, and is visibly distinguishable respective of the article of manufacture, and wherein a thread forming at least a portion of the article of manufacture is dyed by a digitally controlled dyeing machine, thereby authenticating said dyeing of said thread forming said article by said digitally controlled dyeing machine. Optionally, the controller comprises a memory configured to store metadata associated with the article of manufacture, the metadata defining at least the first color, wherein the controller is further configured to digitally control the digitally controlled dyeing machine to dye the thread forming a portion of the artifact in accordance with a first dyeing scheme applying said metadata, and wherein the controller is configured to digitally control the dyeing machine to dye the thread forming a section of the article of manufacture in accordance with a second dyeing scheme applying said metadata associated with said article, wherein the artifact is visibly distinguishable respective of the article of manufacture resulting from said second dyeing scheme differing from said first dyeing scheme. Optionally, the artifact is visibly attached to the article of manufacture, said visible attachment resulting from the continuous thread forming the artifact being said thread forming the article of manufacture. Optionally, the controller is further configured to select a section of the continuous thread for dyeing by the digitally controlled dyeing machine according to the first dyeing scheme, such that said artifact is positioned at a correspondingly selected position on said article of manufacture.

Further embodiments of the disclosure relate to a method for producing an artifact for authenticating a digitally controlled dyeing process, the method comprising: digitally controlling a dyeing process for at least one continuous thread to dye said at least one continuous thread to exhibit at least a first color section and a color gradient section transitioning from said first color section; dyeing said continuous thread to exhibit said at least a first color section and said at least a color gradient section transitioning from said first color section; and forming said artifact from at least a portion of said continuous color gradient section of said at least one continuous thread, wherein said artifact exhibits said continuous color gradient section as distinguished from said first color section, thereby authenticating said dyeing process. Optionally, at most 10% of said continuous thread is dyed to form said artifact. Optionally, forming said artifact comprises stitching said digitally controlled dyed continuous thread to form said artifact, wherein said stitching comprises performing an action selected from the group consisting of: embroidering said digitally controlled dyed continuous thread wherein said artifact forms an embroidered pattern, sewing said digitally controlled dyed continuous thread wherein said artifact forms a stitch, knitting said digitally controlled dyed continuous thread wherein said artifact forms a knitted pattern, weaving said digitally controlled dyed continuous thread wherein said artifact forms a woven pattern, and crocheting said digitally controlled dyed continuous thread wherein said artifact forms a woven pattern. The method may further comprise: digitally controlling a dyeing process of a thread forming a portion of an article of manufacture, wherein said artifact visually corresponds to said article, and is visibly distinguishable respective of said article, and providing said artifact with said article, thereby authenticating said digitally controlled dyeing of said thread forming said at least portion of said article. Optionally, digitally controlling said dyeing process for said thread forming said at least portion of said article comprises dyeing according to a second dyeing scheme applied to metadata associated with said article, said metadata defining at least said first color, and wherein digitally controlling said dyeing process for said continuous thread forming said artifact comprises dyeing according to a first dyeing scheme applied to said metadata associated with said article, wherein said artifact being visibly distinguishable respective of said dyed article results from said first dyeing scheme differing from said second dyeing scheme. Optionally, said visual correspondence between said artifact and said article comprises said artifact being visibly attached to said article, said visible attachment resulting from said continuous thread forming said artifact being said thread forming said at least portion of said article, the method further comprising digitally controlling said dyeing of said continuous thread in a first dyeing stage for said at least portion of said continuous thread in accordance with said first dyeing scheme, and digitally controlling said dyeing of said portion of the article in a second dyeing stage in accordance with said second dyeing scheme. The method may further comprise selecting a section of said continuous thread for dyeing according to said second dyeing scheme such that said artifact is positioned at a correspondingly selected position on said article.

The disclosed technique provides a system and method for authenticating a digitally controlled dyeing process of a consumer product. An artifact is provided to authenticate the consumer product as having been constructed, in part or in full, using thread that has undergone a digitally controlled dyeing process, such as described hereinbelow with respect to FIGS. 4A-4B. The artifact is visibly distinguishable with respect to the consumer product, and indicates a dyeing capability that distinguishes a digitally controlled dyeing process from a conventional dyeing process. Additionally, to prevent someone from fraudulently affixing a digitally dyed label to a conventionally dyed product, in some embodiments, the artifact is dyed at least one of the colors used to dye at least one of the threads used in the consumer product. This indicates that the dyeing process for the artifact used at least some of the metadata used in the dyeing process for the consumer product. According to an embodiment, the metadata used in the dyeing process comprises the color scheme. In other embodiments, the consumer product may be manufactured in a manner to visually indicate that the artifact and consumer product are formed from the same thread, yarn, or filament. These features indicate that the thread used in the consumer product was dyed using the digitally controlled dyeing process, and not a conventional process. Consequently, environmentally aware consumers can easily and quickly authenticate the consumer product as having been digitally dyed. Furthermore, the artifact attests to additional benefits of digital over conventional dyeing, such as improved color fastness to exposure to UV radiation.

The artifact may take on any suitable shape, such as a recognizable logo, pattern, finishing stitch, and the like. For example, the artifact may be a recognized symbol or mark representing an environmental or ecological conservation organization. The section of the thread forming the artifact may be dyed in a manner to exhibit a color pattern that is attainable exclusively through digitally controlled dyeing techniques. For example, the section of the thread forming the artifact may be dyed according to a color gradient that presents a continuous change between two or more colors. Alternatively, the section of the thread may be dyed according to a color pattern to differentiate the section from the remainder of the thread that forms the consumer product. In one implementation, the artifact is dyed at least some of the colors as the consumer product, to authenticate that both the consumer product and the corresponding artifact were dyed using digitally controlled dyeing means. For example, if the consumer product is a t-shirt dyed specific shades of green, blue, and white, the artifact authenticating the dyeing process for the t-shirt may have the shape of a recognized logo, dyed the same specific shades of green, blue and white as the t-shirt.

In conventional dyeing processes, single threads are generally dyed a single color. In digitally controlled dyeing processes, a single thread may be dyed multiple colors in a precise way. Furthermore, dyed thread comprising color gradients having precise colors can not be mass produced using conventional dyeing processes.

Although single threads may be irregularly dyed multiple colors through conventional dyeing processes, for example, through space dyeing, these processes do not provide specific, regular color gradients. In space dyeing, loose sections of thread are placed in a large container and dye is poured over various loose sections, dipping as necessary to produce varying colors.

According to an embodiment, the color gradient portion of the continuous artifact thread has a length of between 5 millimeters and 1000 meters. According to an embodiment, the gradient portion of the color portion of the continuous artifact thread is formed into an artifact, the artifact surface area having a size of between 0.1% and 10% of the product surface area.

Although the description and examples relate to dyeing thread, the disclosed technique may be applicable to any type of fiber, such as a filament, yarn, string and the like of which, by virtue of agnostic natures, can then be used to connect pieces through stitching for forming at least a portion of a product. Additionally, although the description relates to dyeing thread, the techniques disclosed herein may be applicable to the textile industry in general for dyeing fabric, using other dyeable substrates.

Unless otherwise explained, all technical and scientific terms used herein have the same meaning as commonly understood by one of ordinary skill in the art to which this disclosure belongs. The singular terms "a," "an," and "the" include plural referents unless context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." The abbreviation, "e.g." is derived from the Latin exempli gratia, and is used herein to indicate a non-limiting example. The term "consisting essentially of" means that the including the specified materials or steps, and those that do not materially affect the basic and novel characteristics of the claimed invention.

In case of conflict, the present specification, including explanations of terms, will control. In addition, all the materials, methods, and examples are illustrative and not intended to be limiting.

Terms:

Article of Manufacture: An object produced by a manufacturing process. Exemplary manufacturing processes include weaving, stitching, knitting and embroidery. Exemplary articles of manufacture may include: textile, garments, footwear, underwear, sportswear, upholstery and headwear.

Artifact: A visible element present on an article of manufacture comprising a fiber. An artifact may be used to indicate information relevant to the article of manufacture. The artifact may be attached to the article of manufacture or may be an integral part of the article of manufacture.

Color Gradient: A gradual transition from one color hue to another or from one shade to another. Preferably, a color gradient is a transition visible to an unaided human eye. A color gradient may be applied to a single, continuous fiber or thread.

Color Gradient Portion: A portion of an article in which a gradual transition from one color or hue to another is visibly recognizable.

Conventional Dyeing Process: A process in which a fiber-based product is immersed, typically as a spool of thread or spooled fiber, or a portion thereof, into a container comprising a dye of a single color, shade or hue, then dried. Conventional dyeing process also includes a space dyeing process.

Digitally Controlled Dyeing Process: A process in which a fiber-based product, such as a thread, is linearly fed while a dye is deposited on the fiber-based product. Optionally, the fiber may be fed through a container comprising a dye. Color and amount of the dye fed into the container and linear motion of the thread through the container is controlled by an electronic controller to achieve a specific color of the thread, preferably controlled to provide a specified color at specific points along the length of the thread.

Fiber: A synthetic or natural elongated product which can form a textile. Fiber can be spun to form a thread.

Label: An indicator attached to an article of manufacture to indicate information about the article of manufacture. The indicator may comprise a logo, a description of the article, a description of the origin of the article or of the manufacturer of the article. The label may be made from textile and may comprise a stitched element. The label may comprise a printed element.

Metadata: Data associated with an article of manufacture, used by a controller in a digitally controlled dyeing process to control a quality of a dyed product. Preferably the metadata may comprise a color scheme relating to color of a fiber or thread over various segments of the length of the fiber or thread.

Product: a manufactured article comprising a textile.

Textile: A cloth or woven fabric comprising a thread. A textile may also be non-woven fabric, such as felt.

Thread: A long, thin strand of fiber. May be used in sewing, weaving, and other processes suitable for the preparation of articles of manufacture as herein disclosed.

Visibly Distinguishable: Visible by the naked eye without the aid of an external machine such as a microscope or colorimeter.

Reference is now made to FIG. 1A which shows an artifact 100 for authenticating a digitally controlled dyeing process, constructed and operative in accordance with an embodiment of the disclosed techniques. Artifact 100 is shown exhibiting a pattern or logo 102 formed from at least a portion of at least one continuous thread 106. Thread 106 may be embroidered, knitted, crocheted, woven or otherwise manipulated to form logo 102 on a product 120 (not shown), at least a portion of which is formed from a digitally dyed thread, or yarn 122. Thread 106 is dyed using the digitally controlled dyeing process to exhibit at least a first color 108 on one section of thread 106, as well as a color gradient 112 on another, adjacent section of thread 106, the color gradient transitioning from the first color 108 to another color 110. Artifact 100 exhibits at least a portion of the color gradient section 112 of continuous thread 106 in a manner to distinguish artifact 100 from the section of thread 106 dyed the first color 108. This distinguishing feature of color gradient 112, as distinguished from the section of thread 106 dyed the first color 108, indicates a distinguishing dyeing capability of the digitally controlled dying process used to manufacture artifact 100, and serves to authenticate the dyeing process for artifact 100. It is to be noted that thread 106 may be dyed any number of colors in accordance with the capability of the digitally controlled dyeing process.

Optionally, color 110 corresponds to an undyed state of thread 106, i.e. color 110 is the native color of the thread (e.g., white or ecru). In this embodiment, color gradient 112 fades continuously from color 108 to undyed, each shade of the fading color gradient 112 being a different dyed color. Alternatively, color 110 and color 108 are two different dyed colors, such as red and blue. In this embodiment, color gradient 112 transitions continuously from red to blue, each shade of the transition between red to blue of color gradient 112 being a different dyed color. In one embodiment, the transition from color 108 to color 110 in gradient 112 is over a length of thread 106 measuring between 5 millimeters and 1000 meters.

Figure 1B:
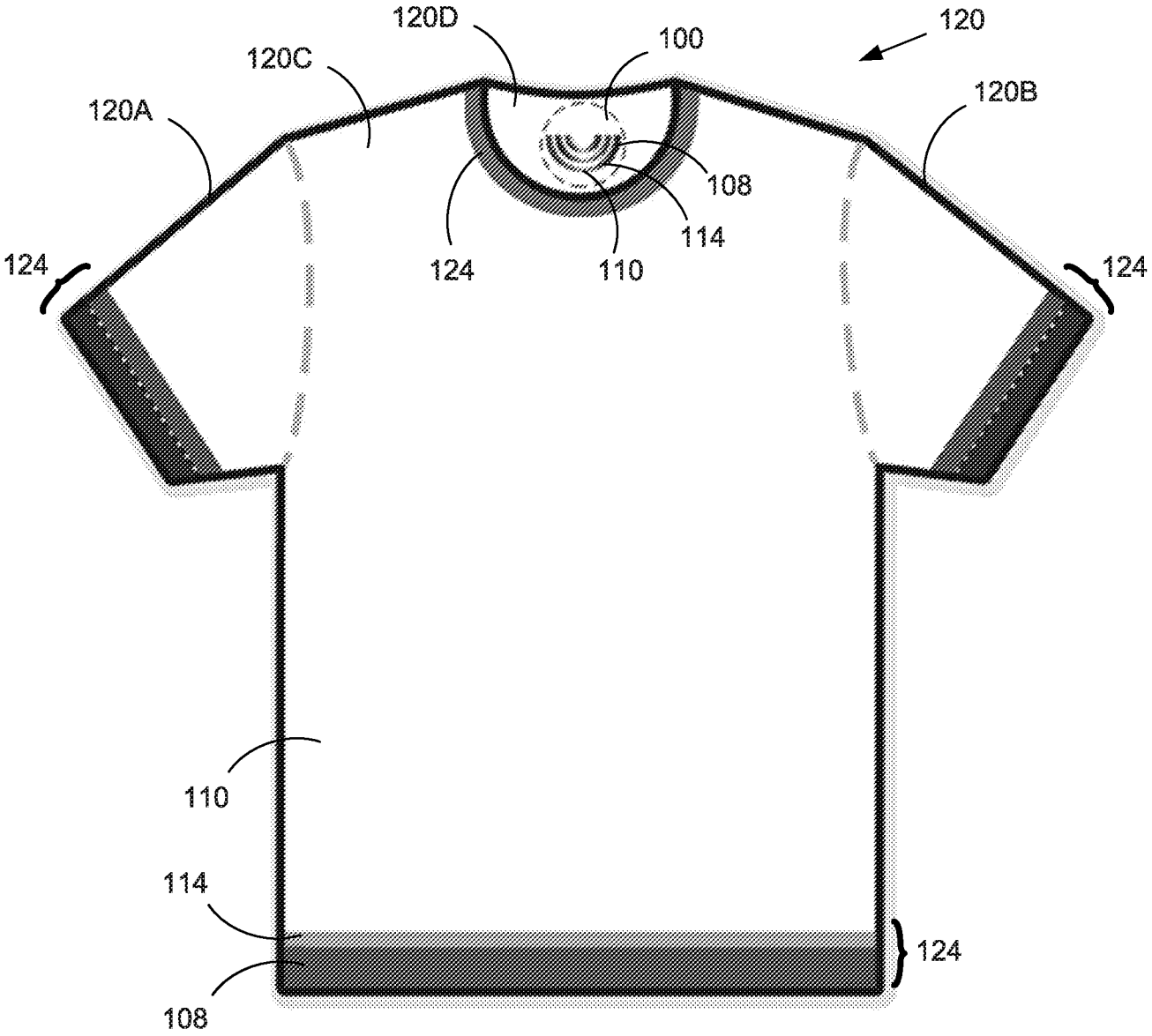

Reference is now made to FIG. 1B, which together with FIG. 1A, is a schematic illustration of artifact 100, authenticating product 120, constructed and operative with another embodiment of the disclosed techniques. At least a portion of product 120 is formed from thread 122, shown in FIG. 1A, that has been dyed using the same digitally controlled dyeing process used to dye thread 106 forming artifact 100. Artifact 100 is provided with product 120 to authenticate the digitally controlled dyeing process for thread 122. To accomplish this, artifact 100 corresponds visually to product 120 while being visibly distinguishable with respect to product 120, allowing a potential consumer to discern artifact 100 from product 120. For example, artifact 100 may be a recognizable multi-colored logo, where at least one of the multiple colors of artifact 100 matches at least one of the non-artifact colors of product 120.

The visual correspondence between product 120 and artifact 100 may be achieved by using at least some of the metadata defining the colors for dyeing thread 122 forming the at least portion of product 120, to dye thread 106 forming artifact 100. As a result of using at least some of the same metadata to dye each of thread 122 and thread 106, the at least portion of product 120 formed from dyed thread 122, has a visual correspondence with artifact 100, formed from dyed thread 106. For example, if the metadata for product 120 defines a single color, i.e. color 108, for dyeing thread 122 to form product 120 as a solid color knit, then at least one of the colors used to dyed thread 106 forming artifact 100 is color 108.

In one embodiment, artifact 100 is designed as a full logo or part of a logo that includes a color swatch dedicated for authentication purposes, and a preconfigured segment of thread 106, corresponding to the color swatch of the logo, is dyed to match at least one of the colors of product 120. For example, artifact 100 may be a portion of a recognizable logo 102 displaying a spectrum of colors, such as a rainbow with each color of the spectrum transitioning continuously into the next color. Artifact 100 may be a predefined part of the rainbow that is dedicated as the color swatch for authenticating product 120. In this case, a section of thread 106 is dyed color 108 transitioning in a color gradient to one of the neighboring colors of the rainbow. The section of thread 106 exhibiting the color gradient forms artifact 100.

In another embodiment, the metadata for product 120 defines multiple colors. The metadata is applied to dye thread 122 in a manner to produce a multi-color pattern when dyed thread 122 is knitted to form the at least portion of dyed product 120. Such a pattern may include geometric shapes, stripes, checks, dots and the like. FIG. 1B shows product 120 comprising multiple pieces: two sleeves 120A and 120B, a front piece 120C and a back piece 120D, sewn together to form, by way of non-limiting example, a t-shirt. Each of pieces 120A-120D is formed from a separate thread or yarn, 122A-122D, respectively (not shown) that are each dyed multiple colors to produce a multi-colored band 124 on a colored background when knitted to form the respective piece 120A-120D. In the example shown in FIGS. 1A-1B, bands 124 include a stripe dyed color 108 and a stripe dyed color 114, and the background color for each of pieces 120A-120D is color 110. Accordingly, different sections of each of threads 122A-122D are dyed respective colors 108, 114, and 110, in a manner to produce bands 124 on a background of color 110 when each of threads 122A-122D are knitted to form each respective piece 120A-120D. The sections for dyeing threads 122A-122D respective colors 108, 114, and 110 may be determined according to the length of thread required to implement each stitch for knitting each of pieces 120A-120D from respective threads 122A-122D.

In another embodiment, each piece 120A-120D of multi-colored product 120 is formed by knitting sections of multiple different threads, 122A, 122B, and 122C, each thread dyed a different respective one of colors 108, 110, and 114. The metadata defining the color scheme for product 120 is applied in multiple dyeing stages of the digitally controlled dyeing process for product 120, each stage corresponding to a different color defined by the metadata, and for dyeing a different one of threads 122A, 122B and 122C. In the first stage, thread 122A is dyed color 108, in the second stage, thread 122B is dyed color 110, and in the third stage thread 122C is dyed color 114. Product 120 is subsequently formed from multiple threads 122A, 122B, and 122C. The metadata defining the color scheme for product 120 is then applied to dye the single continuous thread 106 all three colors 108, 110, and 114 along different sections of the same continuous thread 106. Artifact 100, subsequently formed from single continuous thread 106, authenticates the dyeing process for threads 122A, 122B, and 122C, as follows:

Thread 106 forming artifact 100 is dyed colors 108, 114, and 110, in a manner to present a color gradient in the transition between each respective color. In the example of FIG. 1B, artifact 100 is a portion of embroidered logo 102 formed from dyed thread 106, and positioned on the front-facing side of piece 120D of product 120. Logo 102 presents colors 108, 114 and 110, and a color gradient in the transition between each of colors 108, 114, and 110. A portion of logo 102 exhibiting at least part of the color gradient forms artifact 100 and authenticates the digitally controlled dyeing process used to produce product 120. However, this embodiment is not meant to be limiting, and artifact 100 may be disposed at any suitable position on one or more of pieces 120A-120D of product 120, such as on a separate label sewn on to product 120, and the like. By presenting the combination of a color gradient, indicative of a digitally controlled dyeing process, together with the colors for product 120, artifact 100 authenticates that product 120 was manufactured using the digitally controlled dyeing process.

According to an embodiment, a color gradient may be transitioning between 2, 3, 4, 5, 6, 7, 8, 9, 10 or more visibly distinguishable colors.

In general, thread 106, of which a portion forms identifying artifact 100, is dyed according to at least one color defined by the metadata associated with product 120; however the dyeing of thread 106 is implemented according to a different dyeing scheme than the dyeing scheme applied for dying thread 122 for product 120 in the non-artifact area. As a result, identifying artifact 100 is visibly distinguishable respective of product 120, while still corresponding visually to product 120. For example, the dyeing scheme for threads 122A-122D forms multi-colored bands 124 when threads 122A-122D are knitted to form pieces 120A-120D, exhibiting stripes dyed colors 108 and 114 against a background of color 110. By contrast, the dyeing scheme for thread 106 forms three rainbow arcs, presenting a color gradient between colors 108, 114 and 110 when thread 106 is embroidered to form artifact 100. In another embodiment, identifying artifact 100 may exhibit a color gradient transitioning between white or undyed and at least one of the colors of product 120.

Figure 2:
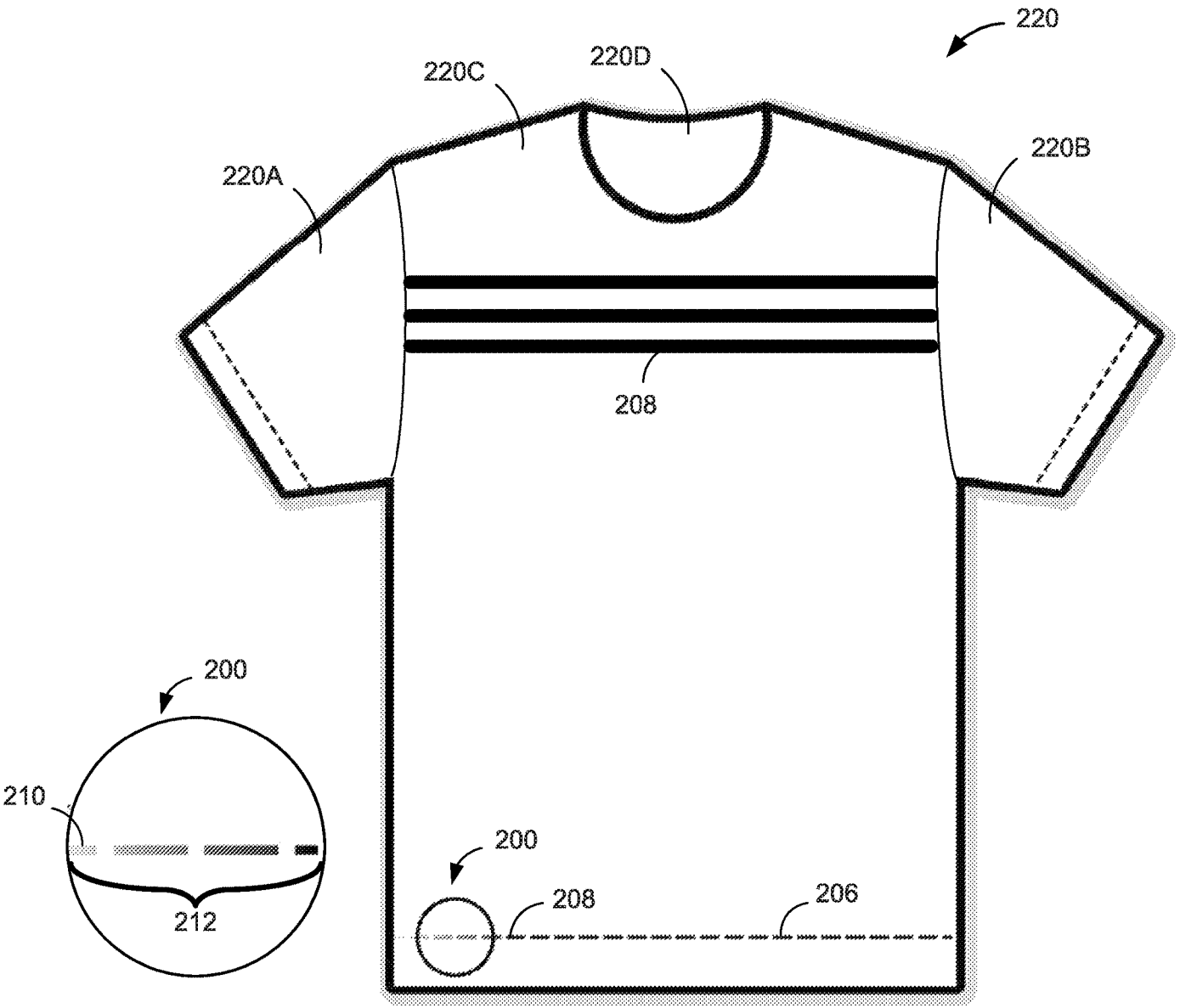
FIG. 2 is a schematic illustration of an artifact authenticating a digitally controlled dyeing process of a dyed product, constructed and operative with another embodiment of the disclosed techniques.

Reference is now made to FIG. 2 which is a schematic illustration of an artifact 200, authenticating a product 220, constructed and operative with another embodiment of the disclosed techniques. At least a portion of product 220 is formed from one or more threads or yarns 222 (not shown) that have been dyed at least one color, i.e. color 208, using a digitally controlled dyeing process. For example, product 220 may be a knit formed by knitting the one or more threads 220, and color 208 may be presented as one or more colored stripes on product 220. Alternatively, product 220 is a solid colored knit, dyed color 208. Artifact 200 is provided with product 220 to authenticate the digitally controlled dyeing process for thread 222 forming product 220. To accomplish this, artifact 200 corresponds visually to product 220, while being visibly distinguishable with respect to product 220, allowing a potential consumer to discern artifact 200 from product 220.

Artifact 200 is formed from at least a portion of at least one continuous thread 206. Thread 206 is dyed using the digitally controlled dyeing process to exhibit at least a first color 208 on one section of thread 206, as well as a color gradient 212 on another adjacent section of thread 206, the color gradient transitioning in a continuous manner from the first color 208 to another color 210. Artifact 200 exhibits at least a portion of the color gradient section 212 of continuous thread 206 in a manner to distinguish artifact 200 from the section of thread 206 dyed the first color 208. This distinguishing feature of color gradient 212, as distinguished from the section of thread 206 dyed the first color 208, indicates a distinguishing dyeing capability of the digitally controlled dying process used to manufacture artifact 200 and product 220. This serves to authenticate that product 220 was manufactured using the digitally controlled dyeing process.

In the example shown in the zoomed-in area of FIG. 2, thread 206 displays a visibly distinguishable color gradient 212 presenting a continuous change of color to color 210 as distinguished from color 208. This color gradient is indicative of a digitally controlled dyeing process. It is to be noted that thread 206 may be dyed any number of colors in accordance with the capability of the digitally controlled dyeing process. In some embodiments, the section of thread 206 dyed to form artifact 200 is at one of the ends of thread 206, such as when artifact 200 is a finishing stitch. In other embodiments, the section of thread 206 dyed to form artifact 200 is in the middle of thread 206 or any other non-terminal section of the thread, such as when artifact 200 is embedded within the middle or any other intermediate area of the product of the stitching by thread 206.

In one embodiment, artifact 200 is formed from a thread 206 which is used to assemble pieces 220A-220D, corresponding to pieces 120A-120D of FIG. 1B, into product 220. Alternatively, artifact 200 may be a finishing stitch, or a series of stitches a or a seam on at least one of pieces 220A-220D, where at least one of the multiple colors of artifact 200 matches at least one of the colors of product 220. As with artifact 100 of FIGS. 1A-1B, thread 206 forming artifact 200 is dyed according to at least one color defined in the metadata that defines the colors for product 220. In this manner, a visual correspondence between artifact 200 and product 220 is attained. For example, thread 206 may be used in an overlock stitch to finish each of pieces 220A-22D, and may be visible only in the inner sides of product 220, i.e. artifact 200 is not visible when product 220 is worn. The overlock stitches exhibit at least color 208 in a manner to indicate a distinguishing dyeing capability of a digitally controlled dyeing process. For example, if product 220 is a t-shirt dyed a specific shade of blue, the overlock stitch formed from thread 206 and finishing the edges of each of pieces 220A-220D, visible only from the inside of the t-shirt, presents the specific shade of blue transitioning in a color gradient to one or more additional colors different from the initial specific shade of blue.

In one embodiment, only a small section, such as ranging between 1% and 10% of the length of the continuous thread 206, presents the distinguishing dyeing capability of the digitally controlled dyeing process. Continuing the example above, the majority of thread 206, which may range several meters, is dyed the specific shade of blue to match product 220, and only the last 20 cm are dyed to indicate a color gradient between the specific shade of blue and another color, to indicate a digitally controlled dyeing process. Thus, only a small number of the overlock stitches from the total number of overlock stitches used for assembling product 220 form artifact 200.

Figure 3A:
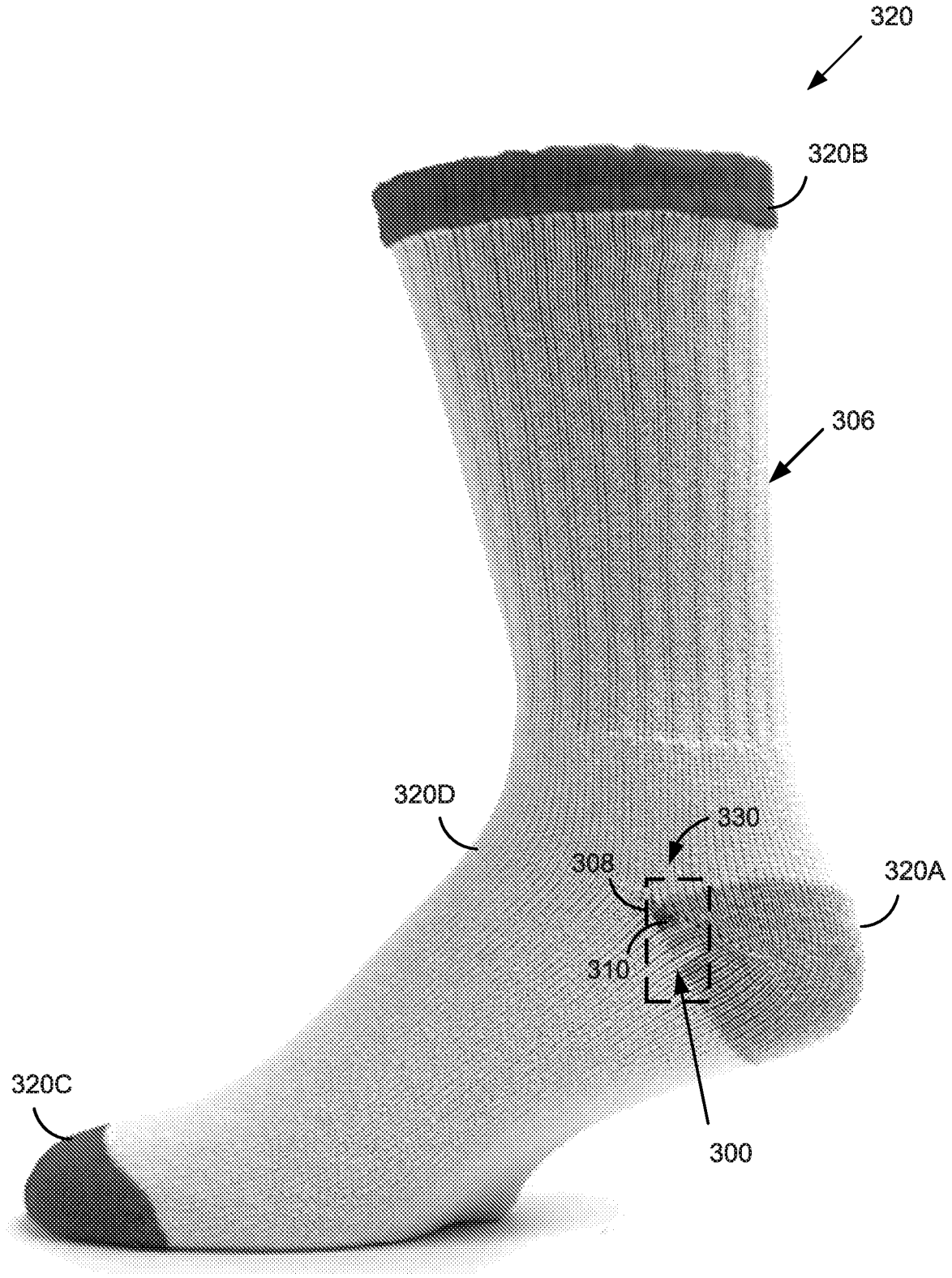
FIGS. 3A-3B, taken together, are a schematic illustration of an artifact authenticating a digitally controlled dyeing process of a dyed product, constructed and operative with another embodiment of the disclosed techniques.
Figure 3B:
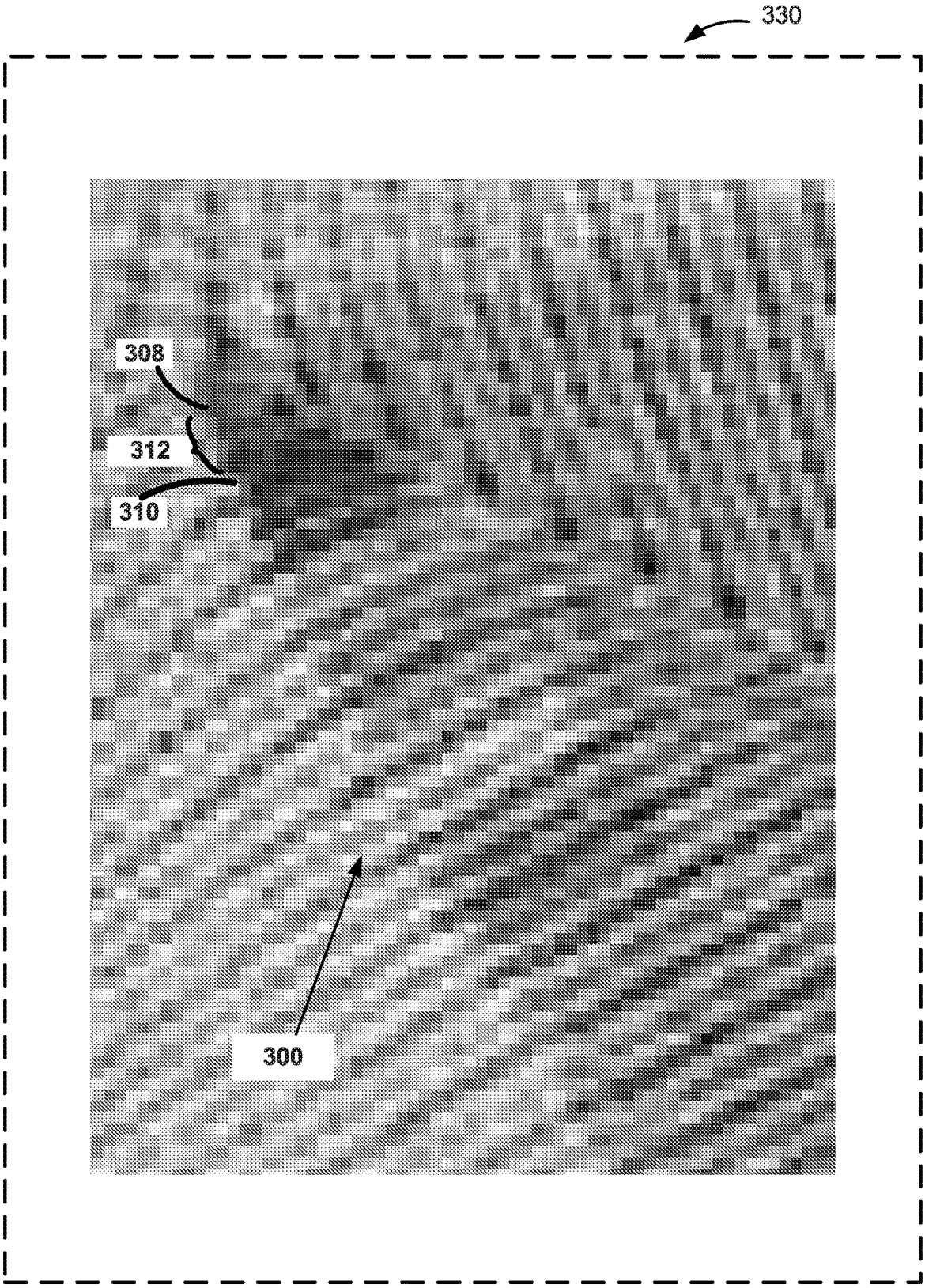

Reference is now made to FIGS. 3A-3B which, taken together, are schematic illustrations of an artifact 300, authenticating a product 320, constructed and operative with another embodiment of the disclosed techniques. FIG. 3A illustrates product 320 with an artifact 300, indicated in dashed box 330, and FIG. 3B is a zoomed-in view of dashed box 330. In this embodiment, at least a portion of product 320 is visibly attached to artifact 300, by being formed from a single continuous dyed thread 306, an indication of which is visible to a consumer of manufactured product 320. For example, as shown in FIG. 3A, product 320 is a sock knit from a single dyed thread 306. In one embodiment, the various colored sections of product 320, including gray-toned heel 320A, multi-colored artifact 300, colored band 320B, and colored toe 320C, and sock body 320D are all formed from single dyed thread or yarn 306, dyed using a digitally controlled dyeing process. The section of continuous thread 306 forming dyed product 320 and the section of continuous thread 306 forming artifact 300 are each dyed in different stages of the digitally controlled dyeing process for continuous thread 306. In other words, each of product 320 and artifact 300 are manufactured using different stages of the digitally controlled dyeing process applied to continuous thread 306. Artifact 300 is formed by dyeing a selected section of continuous thread 306 in a manner to position artifact 300 at a correspondingly selected position on product 320, when thread 306 is knitted to form product 320, i.e. as a detail on the heel of a sock. In some embodiments, the selected section of thread 306 forming artifact 300 ranges between 1% and 10% of thread 306. In some embodiments, the selected section of thread 306 dyed to form artifact 300 is at one of the ends of thread 306. In other embodiments, the section of thread 306 dyed to form artifact 300 is in the middle of thread 306, such as when artifact 300 is embedded within product 320.

Artifact 300 is visibly distinguishable with respect to product 320 and identifies a distinguishing dyeing capability of the dyeing process as applied to the section of thread 306 used to form artifact 300, as described above with respect to FIGS. 1A-1B and FIG. 2. For example, artifact 300 may present a distinctive pattern that is indicative of the digitally controlled dyeing process, such as a color gradient 312 between at least two colors, 308 and 310. Similarly, in some embodiments, artifact 300 exhibits at least one of the colors included in the metadata defining the color scheme for product 320, such as at least one of the colors included in gray-toned heel 320A, colored band 320B, and colored toe 320C, and sock body 320D. In this manner, artifact 300 authenticates the digitally controlled dyeing process for dyed product 320.

The combination of these features: the visible indication that identifying artifact 300 and dyed product 320 are formed from continuous thread 306, together with the distinguishing color features presented by artifact 300 indicating a digitally controlled dyeing process, serve to authenticate dyed product 320 as having been manufactured, in part or in full, using a digitally controlled dyeing process.

In another embodiment, heel 320A, colored bands 320B, 320C, and sock body 320D are each formed from a separately dyed thread, i.e. threads 306A-306D, where thread 320A is dyed gray, forming heel 320A; threads 306B,306C are dyed red, forming colored bands 320B, 320C; and thread 306D is dyed white, forming sock body 320D. Each of threads 306A-306D is dyed using the digitally controlled dyeing process. Additionally, a section of at least one of threads 306A-306D is dyed to form artifact 300, which is subsequently integrally formed with the respective one of pieces 320A-320D of product 320. For example, a section of thread 306A forming heel 320A is dyed multiple colors in a manner to indicate a distinguishing dyeing capability of the digitally controlled dyeing process. In one implementation, the section of thread 306A forming heel 320A of sock 320 may be dyed a spectrum of colors to form artifact 300 presenting a rainbow on heel 320A. The colors of the rainbow may present a color gradient therebetween, to authenticate the digitally controlled dyeing process. Alternatively, a section of thread 306A forming heel 320A may be dyed in a manner to present a color gradient from red to gray to white, corresponding to the colors of pieces 320A-320D of sock 320.

Figure 4A:
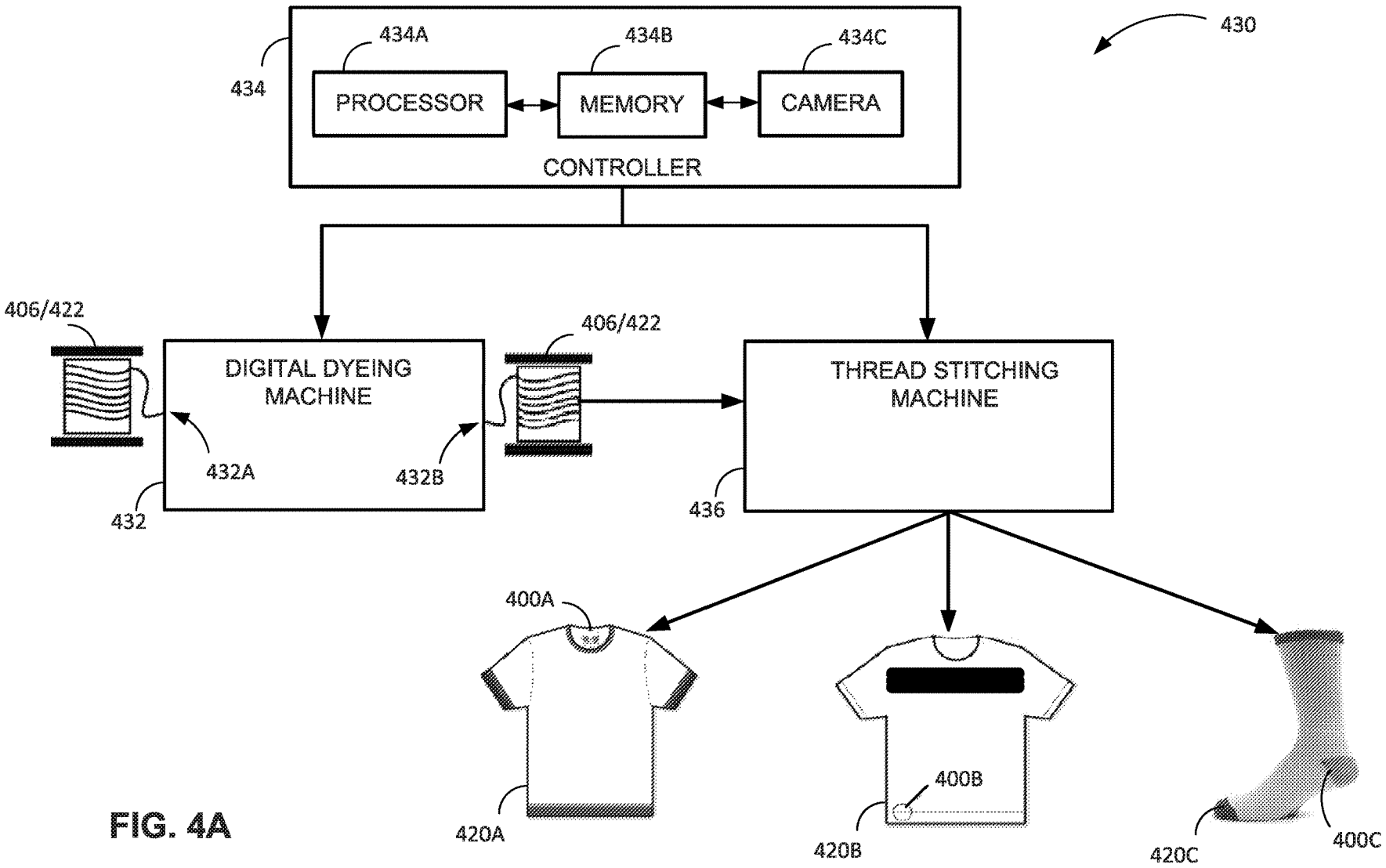
FIG. 4A is a schematic illustration of a system for producing an artifact for authenticating a digitally controlled dyeing process for a dyed product, constructed and operative with another embodiment of the disclosed techniques.

Reference is now made to FIG. 4A, which is a schematic illustration of a system 430 for producing an artifact for authenticating a digitally controlled dyeing process for a dyed product, constructed and operative with another embodiment of the disclosed techniques. System 430 includes a digitally controlled dyeing machine 432, which is described in greater detail hereinbelow with respect to FIG. 4B. System 430 further includes a controller 434, comprising at least one processor 434A and at least one memory 434B. Optionally, controller 434 further includes a camera 434C. System 430 further includes at least one spool of thread 406, corresponding to any of undyed threads 106, 206, 306, 122, 222, and 322 of FIGS. 1A-1B, 2, and 3, above. In some embodiments, a second spool of thread 422 is provided, corresponding to any of undyed threads 122, 222 of FIGS. 1A-1B, 2, and 3, such as when thread 122 differs from thread 106, and when thread 222 differs from thread 206, i.e. when artifacts 100, 200 are embroidered or stitched onto a knit formed by respective threads 122 and 222. System 430 further includes a stitching machine 436. Stitching machine 436 is any of a knitting machine, sewing machine, embroidery machine, crocheting machine, weaving machine, and the like. Accordingly, an artifact produced by stitching machine 436 may be any of a knitted pattern, a finishing stitch, an embroidered logo, a crocheted pattern, a woven pattern, and the like, where this list is not intended to be limiting.

Processor 434A is electronically coupled to memory 434B, and optional camera 434C of controller 434. Controller 434 is in digital communication with dyeing machine 432. Optionally, controller 434 is in digital communication with stitching machine 436. Thread 406, when undyed, is mechanically coupled to an input port 432A of dyeing machine 432, in a manner to allow dyeing machine 432 to dye threads 406 and 422. Dyeing machine 432 dispenses dyed threads 406 and 422 via an output port 432B of dyeing machine 432. Dyed threads 406 and 422 are mechanically coupled with stitching machine 436.

Processor 434A may include any combination of a central processing unit (CPU), graphical processing unit (GPU), digital signal processor (DSP), accelerator processing unit (APU) and the like. Memory 434B is operative to store one or more program code instructions and data, such as one or more images acquired by camera 434C. The program code instructions, when executed by processor 434A, may implement one or more of the methods described herein.

Processor 434A of controller 434 controls the dyeing process by dyeing machine 432 on threads 406 and 422 by controlling: the timing, position, color, quantity and rate of dye deposited on threads 406 and 422, as well as the velocity and tension of threads 406 and 422 as threads 406 and 422 are fed through dyeing machine 432. Processor 434A of controller 434 controls the dyeing of threads 406 and 422 in accordance with metadata stored in memory 434B of controller 434. The metadata defines a color scheme for a dyed product subsequently formed by stitching machine 436 from one of dyed threads 406 and 422. In this manner, the artifact formed from dyed thread 406 subsequently authenticates the dyed product. Optionally, controller 434 additionally controls the stitching process of any of dyed threads 406 and 422 by stitching machine 436. For example, controller 434 may use images obtained by camera 434C to control the tension of any of threads 406 and 422 during the stitching process such that artifact 400 is situated at a predetermined position on product 420.

In one embodiment, stitching machine 436 may include an embroidery machine and/or a knitting machine. Controller 434 controls the dyeing of thread 406 by dyeing machine 432 respective of embroidery stitching and the metadata for a dyed product 420A. Controller 434 further controls the dyeing of thread 422 by dyeing machine respective of knitting stitching and the metadata for dyed product 420A. Subsequently, the knitting machine of stitching machine 436 knits thread 422 to form dyed product 420A, corresponding to dyed product 120 of FIGS. 1A-1B. Additionally, the embroidery machine of stitching machine 436 embroiders artifact 400A onto dyed product 420A, corresponding to artifact 100 of FIGS. 1A-1B.

Alternatively stitching machine 436 may include a knitting machine and a sewing machine. Controller 434 controls the dyeing of thread 422 to form dyed product 420B, similar to the technique described above for dyed product 420A. Additionally controller 434 controls the dyeing of thread 406 by dyeing machine 432 respective of sewing stitches and the metadata for dyed product 420B. Subsequently, the knitting machine of stitching machine 436 knits thread 422 to form dyed product 420B, and the sewing machine of thread stitching machine 436 sews finishing stitches forming artifact 400B on dyed product 420B, i.e. corresponding to artifact 200 and dyed product 220 of FIG. 2.

Alternatively, thread stitching machine 436 is a knitting machine. Controller 434 controls the dyeing of thread 406 by dyeing machine 432 respective of knitting stitches and the metadata of dyed product 420C. Subsequently, thread stitching machine 436 knits artifact 400C with dyed product 420C, corresponding to artifact 300 and dyed product 320 of FIG. 3.

Figure 4B:
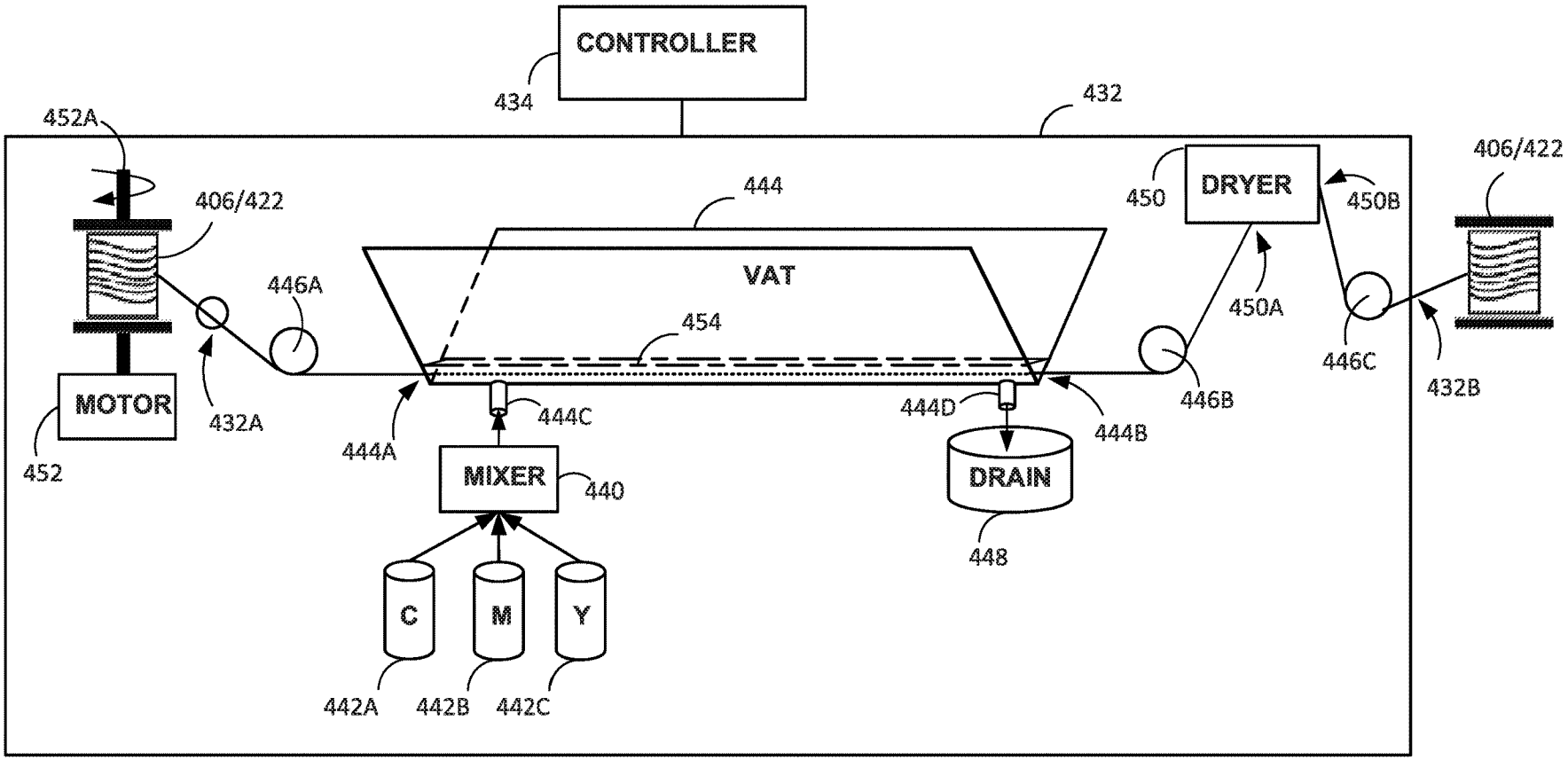
FIG. 4B is a schematic illustration of the digitally controlled dyeing machine of FIG. 4A, constructed and operative with another embodiment of the disclosed techniques.

Reference is now made to FIG. 4B which, taken together with FIG. 4A, is a detailed schematic illustration of a conceptual implementation for dyeing machine 432 of FIG. 4A, constructed and operative in accordance with an embodiment of the disclosed techniques. Dyeing machine 432 includes at least a mixer 440; multiple cartridges of color dyes 442A, 442B, 442C, i.e. cyan (C), yellow (Y), and magenta (M), respectively; a vat 444, multiple tension gauges, i.e. 446A, 446B, 446C; a drain 448; a dryer 450; and a motor 452, input port 432A, and output port 432B.

Threads 406 and 422, prior to dyeing by dyeing machine 432 are mechanically coupled to an axle 452A of motor 452 and input port 432A of dying machine 432. Undyed threads 406 and 422 are mechanically coupled from input port 432A into one side 444A of the bottom region of vat 444 via tension gauge 446A. Threads 406 and 422 are extended along the length of the bottom region of vat 444, where threads 406 and 422 are fluidly coupled with dye 454 released from mixer 440. Thus dyed, threads 406 and 422 extend out from the opposite side, 444B, of the bottom region of vat 444. Dyed threads 406 and 422 are mechanically coupled from side 444B of vat 444, via tension gauge 446B, to an input port 450A of dryer 450. Dyed threads 406 and 422 are coupled from an output port 450B of dryer 450 to output port 432B of dyeing machine 432 via tension gauge 446C.

Cartridges 442A, 442B, 442C are fluidly coupled to mixer 440. Mixer 440 is fluidly coupled to vat 444 at input port 444C of vat 444. Drain 448 is fluidly coupled to vat 444 at output port 444D of vat 444. Controller 434 is electrically coupled at least to motor 452, mixer 440, cartridges 442A, 442B, 442C, tension gauges, 446A, 446B, 446C, drain 448, and dryer 450.

Controller 434 controls the rotational speed of motor 452, thereby controlling the rotation of respective undyed threads 406 and 422 about axle 452A, to control the release of respective threads 406 and 422 into input port 432A. Controller additionally controls the tensions of respective gauges 446A, 446B, and 446C. In this manner, controller 434 controls the speed and tension of respective threads 406 and 422 into and out of vat 444, and thus, the amount of time each respective section of threads 406 and 422 is exposed to absorb dye 454 within vat 444.

Controller 434 additionally controls the quantities of the multiple colored dyes released from respective cartridges 442A, 442B, and 442C into mixer 440, thereby controlling the color of mixed dye 454. The respective dyes are mixed within mixer 440 to compose mixed dye 454. Controller 434 controls the entry of mixed dye 454 from mixer 440 into input port 444C of vat 444, as well as the outflow of mixed dye 454 from output port 444D of vat 444 to drain 448, such as via one or more pumps (not shown). In this manner, controller 434 dynamically controls the color of mixed dye 454 within vat during the dyeing process for any one section of respective threads 406 and 422. At some time intervals of the digital dyeing process, controller 434 may control the color of mixed dye 454 according to the metadata for any of respective consumer products 420A, 420B, and 420C of FIG. 4A. At some intervals, controller 434 may release at least some of the dyes according to an algorithm defining any of respective artifacts 400A, 400B, and 400C, or for a predefined logo, and the like.

Controller 434 controls the drying of subsequently dyed threads 406 and 422 by dryer 450, such as by controlling any of the temperature, air velocity, air pressure, humidity, ventilation, and the like, of dryer 450.

In this manner, controller 434 controls specific dyeing characteristics for specific sections of respective threads 406 and 422. As a result, different sections of respective threads 406 and 422 are dyed different colors, as defined by the metadata, and/or algorithms, stored in memory 434B of controller 434B. When changing colors, controller 434 controls the entry of the new color from mixer 440 into vat 444, and the exit of the previous color from vat 444 to drain 448. Thus, sections of respective threads 406 and 422 may be briefly exposed to a continuous transitioning of concentrations from the previous color to the new color within vat 444. As a result, those sections of respective threads 406 and 422 exhibit a color gradient from the old color to the new color, and indicate that the dyeing of respective threads 406 and 422 was achieve using a digitally controlled dyeing machine, such as dyeing machine 432. It is to be noted that the specific implementation of dyeing machine 432 illustrated in FIG. 4B is intended to be conceptual only, and is not meant to be limiting.

Figure 5:
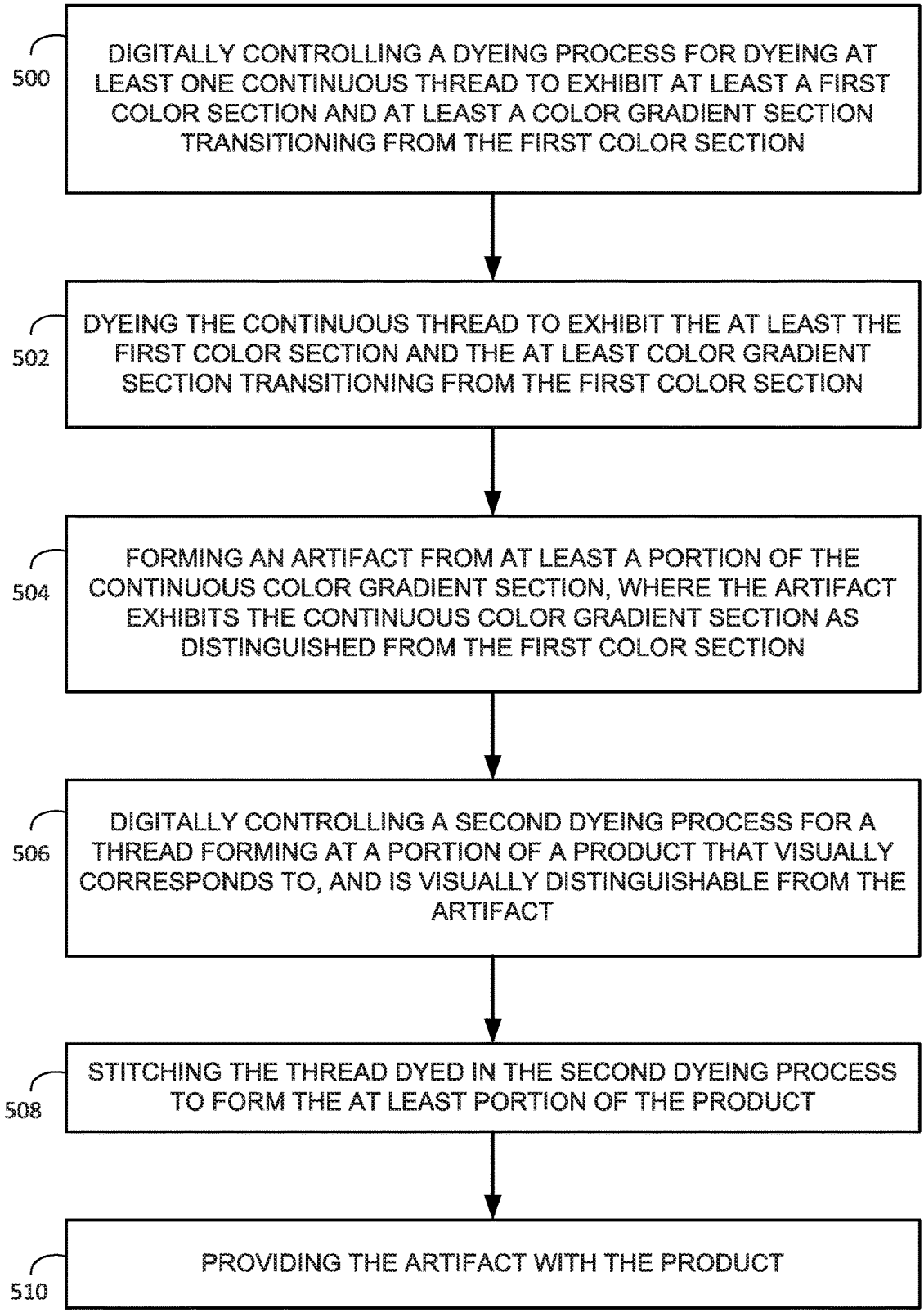
FIG. 5 is a schematic illustration of a method for producing an artifact to authenticate a digitally controlled dyeing process, in accordance with an embodiment of the disclosed techniques.

Reference is now made to FIG. 5 which is a schematic illustration of a method for producing an artifact to authenticate a digitally controlled dyeing process, in accordance with an embodiment of the disclosed techniques. The order of the method is not necessarily according to the numerical order of the procedures provided below.

In procedure 500, a dyeing process for a thread is digitally controlled for dyeing at least one continuous thread to exhibit at least a first color section and at least a continual color gradient section transitioning from the first color section, where the first color section and the continual color gradient section are adjacent.

In procedure 502, the at least one continuous thread is dyed in a first dyeing process to exhibit the at least a first color section and the at least a color gradient section transitioning from the first color section.

In procedure 504, an artifact is formed from at least a portion of the color gradient section of the at least one continuous thread, where the artifact exhibits the color gradient section as distinguished from the first color section. This serves to authenticate the dyeing process respective of the artifact. In some embodiments, the at least second color corresponds to a color of the thread in an undyed state. With reference to FIG. 4A, processor 434A controls dyeing machine 432 to dye thread 406 a first color transitioning in a color gradient to at least a second color, such that any of subsequently formed artifacts 400A, 400B, and 400C exhibit a color gradient as distinguished from the first color, thereby indicating a distinguishing dyeing capability of digitally controlled dyeing machine 432. With reference to FIG. 1A, artifact 100 exhibits a color gradient section 112 as distinguished from color section 108. In some embodiments, at most 1% of the thread is dyed to form the artifact.

In some embodiments, the artifact is formed by stitching the continuous dyed thread. The stitching may be any of: embroidering the continuous dyed thread to form the artifact as an embroidered logo, sewing the continuous dyed thread to form the artifact as a finishing stitch, knitting the continuous dyed thread to form the artifact as a knitted pattern, weaving the continuous dyed thread to form the artifact as a woven pattern, and crocheting the continuous dyed thread to form the artifact as a crocheted pattern. With reference to FIG. 4, thread stitching machine 436 stitches dyed thread 406 to form any of artifacts 400A, 400B, and 400C.

In procedure 506, a second dyeing process for a thread forming at least a portion of a product is digitally controlled, where the artifact visually corresponds to the product, and is visibly distinguishable respective of the at least portion of the product. With reference to FIG. 4A, controller 434 controls a second dyeing process by dyeing machine 432 for a thread 422 that subsequently will form at least a portion of any of products 420A, 420B, and 420C. Controller 434 controls the dyeing of thread 422 and thread 406 such that subsequently formed respective artifacts 400A, 400B, and 400C visually correspond and are visually distinguishable of respective products 420A, 420B, and 420C.

In procedure 508, the thread dyed in the second dyeing process is stitched to form a portion of the product. With reference to FIG. 4A, thread stitching machine 436 stitches dyed thread 422 to form the respective at least portions of products 420A, 420B, and 420C.

In procedure 510, the artifact is provided with the product, thereby authenticating the digitally controlled second dyeing of the thread forming the at least portion of the product. In some embodiments, the thread forming the at least portion of the product is dyed according to a second dyeing scheme applied to metadata associated with the product. The metadata defines at least a color used in dyeing the artifact. Additionally, the thread forming the artifact is dyed according to a first dyeing scheme applied to the same metadata that is associated with the product. In this embodiment, the visibly distinguishable characteristic between the artifact and the product results from the second dyeing scheme differing from the first dyeing scheme. With reference to FIG. 4A, processor 434A of controller 434 controls the dyeing of thread 422 according to a dyeing scheme and metadata associated with one of products 420A, 420B, and 420C. The metadata and dyeing schemes for any of products 420A, 420B, and 420C, and any of artifacts 400A, 400B, 400C are stored in memory 434B of controller 434. Dyeing machine 432 dyes thread 422 accordingly. Processor 434A of controller 434 further controls the dyeing of thread 406 according to the metadata associated with the respective one of products 420A, 420B, and 420C, and a dyeing scheme associated with a respective one of artifacts 400A, 400B, and 400C. Dyeing machine 432 dyes thread 406 accordingly. Subsequently, thread stitching machine forms the respective at least portion of products 420A, 420B, and 420C from dyed thread 422, and respective artifacts 400A, 400B, and 400C from dyed thread 406. Artifacts 400A, 400B, and 400C are associated with respective dyed products 420A, 420B, and 420C, such as by being embroidered thereon, knitted, affixed as a label or tag, stitched thereon, and the like.

In some embodiments, the visual correspondence between the artifact and the product results from the artifact being visibly attached to the product as being formed from a single continuous thread, i.e. the thread forming the artifact and the thread forming the at least portion of the product are the same continuous thread. In this case, the single continuous thread is dyed in a first dyeing stage of the digitally controlled dyeing process for the artifact in accordance with the first dyeing scheme. Furthermore, the single continuous thread is dyed in a second dyeing stage of the digitally controlled process for the at least portion of the product in accordance with the second dyeing scheme. Accordingly, a section of the continuous thread is selected for dyeing according to the first dyeing scheme such that the artifact is positioned at a correspondingly selected position on the product. With reference to FIG. 4A, processor 434A selects sections of thread 406 to subsequently form artifact 400C on sock 420. Processor 434A applies the metadata and the dyeing scheme for dyed product 420C, stored in memory 434B, to control dyeing machine 432 to dye the section of thread 406 selected to form heel of dyed product 420C. Similarly, processor 434A applies the metadata and the dyeing scheme for artifact 400C, stored in memory 434A, to control dyeing machine 432 to dye the section of thread 406 selected to form artifact 400C.

Figure 6:
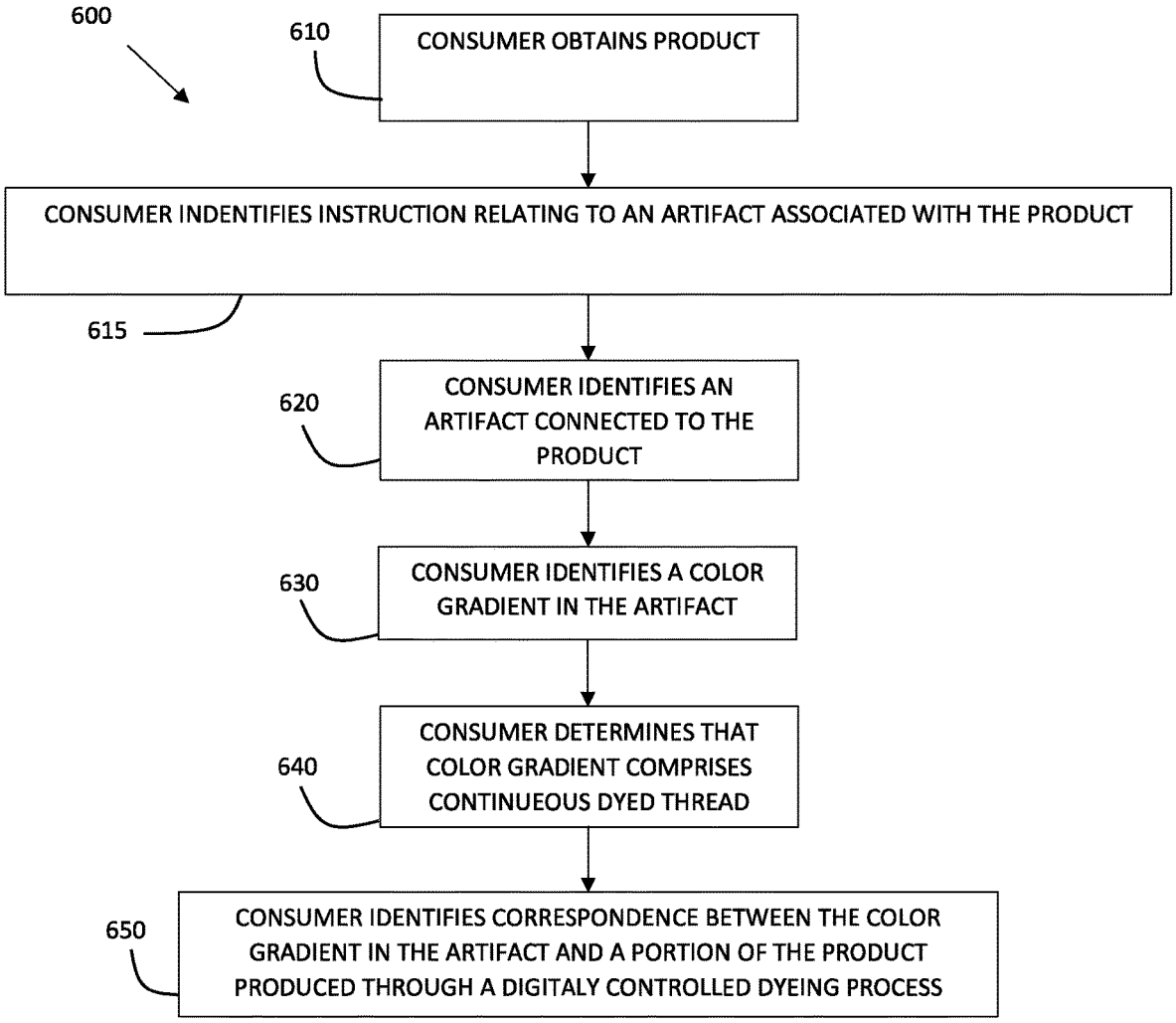
FIG. 6 is a schematic illustration of a method for authentication of a product for determining that a product is produced through a digitally controlled dyeing process, in accordance with an embodiment of the disclosed techniques.

Reference is now made to FIG. 6 which is a schematic illustration of a method 600 for authentication of a product in which a consumer can determine that the product or a portion of the product is produced through a digitally controlled dyeing process, in accordance with an embodiment of the disclosed techniques.

Method 600 comprises block 610, in which consumer obtains a product. The product is a manufactured product comprising a textile, and the textile comprises at least one dyed fiber. The fiber may be a thread. The fiber and/or the product may be dyed according to a color scheme. According to the color scheme, the product may be dyed multiple colors and the colors are visibly distinguishable one from another by the consumer. Optionally, the product comprises textile comprising at least one fiber dyed according to a digitally controlled dyeing process. Optionally, the textile comprises at least one fiber dyed according to a digitally controlled dyeing process which is not visibly identifiable by the naked eye as a fiber dyed according to a digitally controlled dyeing process.

Method 600 optionally comprises block 615 in which a consumer identifies an instruction relating to an artifact connected to the product. The instruction may comprise text indicating that the product comprises a textile comprising at least one fiber dyed according to a digitally controlled dyeing process. The instruction may comprise information indicating the location of the artifact relative to the product. The instruction may comprise information indicating how to determine that the artifact comprises a continuous dyed thread comprising a color gradient. For example, the instruction may be a label with written instruction. Alternatively, the instruction may comprise a link to a website having aforementioned information. Alternatively, the instruction may comprise a QR code scannable by a mobile telephone, tablet or handheld computer device. The QR code may encode a website URL address directing a consumer to a website having aforementioned information. The instruction may comprise information indicating which part of the product is dyed according to a digitally controlled dyeing process.

Method 600 further comprises block 620 in which a consumer identifies an artifact connected to the product. The artifact may be visibly distinguishable from the product. The artifact may be in the form of a label, a logo, a pattern, or a finishing stitch.

Method 600 further comprises block 630 in which a consumer identifies a color gradient in the artifact.

Method 600 further comprises block 640 in which a consumer determines that the color gradient in the artifact comprises a continuous dyed thread, and that the color gradient is formed by the color transition of the continuous dyed thread. If the artifact comprises an embroidered pattern or stitched pattern, the consumer may determine, for example, that the artifact comprises a continuous dyed thread by looking at both sides of the pattern and determining that the pattern is made from a continuous thread.

Method 600 further comprises block 650 in which the consumer visibly identifies correspondence between the color gradient in the artifact formed by the color transition of the continuous dyed thread and the product or a portion of the product produced through a digitally controlled dyeing process, to which the artifact is connected. The correspondence between the color gradient in the artifact may be an identical color, or plurality of colors present in the continuous dyed thread of the gradient and in the portion of the product produced through a digitally controlled dyeing process.

It will be appreciated by persons skilled in the art that the disclosed technique is not limited to what has been particularly shown and described hereinabove. Rather the scope of the disclosed technique is defined only by the claims, which follow.

The invention claimed is:

1. An article of manufacture, comprising, an artifact formed from at least a portion of at least one continuous artifact fiber, the artifact fiber dyed by a first digitally controlled dyeing process to exhibit a visible first color section and a visible color gradient section transitioning from and visibly distinguishable from the first color section; and, a textile portion, comprising at least one dyed fiber that has been dyed by a second digitally controlled dyeing process;

wherein said artifact fiber is dyed by the first dyeing process applying metadata, said metadata relating to at least said first color, and wherein said textile portion fiber is dyed at least said first color by the second dyeing process applying said metadata.

2. The article of manufacture according to claim 1, wherein the artifact fiber is a thread and wherein the textile portion fiber is a thread.

3. The article of manufacture according to claim 1, wherein the artifact forms an embroidered pattern on said article of manufacture.

4. The article of manufacture according to claim 1, wherein the artifact forms a stitch on said article of manufacture.

5. The article of manufacture according to claim 1 wherein the artifact is presented on a label of the article of manufacture.

6. The article of manufacture according to claim 1 wherein the continuous artifact fiber is the same continuous fiber of the textile portion fiber.

7. The article of manufacture according to claim 1, wherein at most 10% of the length of said continuous thread comprises a gradient.

8. The article of manufacture according to claim 1 wherein the artifact further comprises at least a second color.

9. The article of manufacture according to claim 8 wherein the second color corresponds to a color of the continuous thread in an undyed state.

10. The article of manufacture according to claim 1 wherein the metadata comprises a color scheme.

11. The article of manufacture according to claim 1 further comprising instruction relating to the artifact.

12. The article of manufacture according to claim 11 wherein the instructions comprises text or a digital code indicating one or more of: presence of at least one fiber dyed according to a digitally controlled dyeing process and location of the fiber dyed according to a digitally controlled dyeing process in the article of manufacture.

13. The article of manufacture according to claim 1 wherein the artifact fiber color gradient section is between 5 millimeters and 1000 meters long.

14. The article of manufacture according to claim 1 wherein the article comprises between 1 and 100 percent dyed fiber that has been dyed by a second digitally controlled dyeing process.

15. The article of manufacture according to claim 1 wherein the artifact surface area is between 0.1% and 10% of the article surface area.

16. The article of manufacture according to claim 1, wherein at most 10% of the length of said continuous thread forms the artifact.

17. The article of manufacture according to claim 1, wherein at most 1% of the length of said continuous thread forms the artifact.

18. A system for producing an artifact authenticating a digitally controlled dyeing process, comprising: a digitally controlled dyeing machine configured to dye at least one continuous thread to exhibit a first color section, and a color gradient section transitioning from said first color section, a controller configured to digitally control the digitally controlled dyeing machine to dye the continuous thread such that an artifact subsequently formed from the dyed thread exhibits at least a portion of the color gradient section, as distinguished from said first color section, thereby authenticating said dyeing process respective of said artifact.

19. A method for producing an artifact for authenticating a digitally controlled dyeing process, the method comprising:

digitally controlling a dyeing process for at least one continuous thread to dye said at least one continuous thread to exhibit at least a first color section and a color gradient section transitioning from said first color section;

dyeing said continuous thread to exhibit said at least a first color section and said at least a color gradient section transitioning from said first color section; and forming said artifact from at least a portion of said continuous color gradient section of said at least one continuous thread, wherein said artifact exhibits said continuous color gradient section as distinguished from said first color section, thereby authenticating said dyeing process.

20. The method of claim 19, wherein forming said artifact comprises stitching said digitally controlled dyed continuous thread to form said artifact, wherein said stitching comprises performing an action selected from the group consisting of: embroidering said digitally controlled dyed continuous thread wherein said artifact forms an embroidered pattern, sewing said digitally controlled dyed continuous thread wherein said artifact forms a stitch, knitting said digitally controlled dyed continuous thread wherein said artifact forms a knitted pattern, weaving said digitally controlled dyed continuous thread wherein said artifact forms a woven pattern, and crocheting said digitally controlled dyed continuous thread wherein said artifact forms a woven pattern.

* * * * *